US011479439B2

(12) United States Patent
Anderson et al.

(10) Patent No.: US 11,479,439 B2
(45) Date of Patent: Oct. 25, 2022

(54) UNIDIRECTIONAL LOCKING SPOOL

(71) Applicant: Anderson Travis Holdings, LLC, Tompkinsville, KY (US)

(72) Inventors: Kerry B. Anderson, Tompkinsville, KY (US); Johnny Travis, Glasgow, KY (US)

(73) Assignee: Anderson Travis Holdings, LLC, Tompkinsville, KY (US)

( * ) Notice: Subject to any disclaimer, the term of this patent is extended or adjusted under 35 U.S.C. 154(b) by 102 days.

(21) Appl. No.: 16/991,004

(22) Filed: Aug. 11, 2020

(65) Prior Publication Data

US 2022/0048725 A1 Feb. 17, 2022

(51) Int. Cl.
*B65H 75/14* (2006.01)
*B65H 75/22* (2006.01)
*B65H 75/44* (2006.01)

(52) U.S. Cl.
CPC ..... *B65H 75/14* (2013.01); *B65H 75/22* (2013.01); *B65H 75/4428* (2013.01)

(58) Field of Classification Search
CPC ..... B65H 75/14; B65H 75/22; B65H 75/30; B65H 75/146; B65H 75/4428; B65H 49/32
See application file for complete search history.

(56) References Cited

U.S. PATENT DOCUMENTS

| | | | | |
|---|---|---|---|---|
| 1,000,356 | A * | 8/1911 | Bigbee, Jr. | B23B 33/00 82/166 |
| 9,004,392 | B1 * | 4/2015 | Bigbee, Jr | B65H 75/44 242/608.1 |
| 9,444,078 | B2 * | 9/2016 | Tucholski | H01M 4/70 |
| 9,452,908 | B1 * | 9/2016 | Bigbee, Jr | B65H 49/324 |
| 9,738,485 | B1 * | 8/2017 | Bigbee, Jr | B65H 49/32 |
| 9,815,658 | B1 * | 11/2017 | Bigbee, Jr | B65H 49/32 |
| 10,421,636 | B1 * | 9/2019 | Bigbee, Jr | B65H 75/18 |
| 2015/0321876 | A1 * | 11/2015 | Galindo Gonzalez | B65H 75/30 242/614 |

* cited by examiner

*Primary Examiner* — Sang K Kim
(74) *Attorney, Agent, or Firm* — Mark A. Pitchford; Eric B. Fugett; Pitchford Fugett, PLLC

(57) ABSTRACT

The spool for storing and distributing linear product has a drum and inner flanges defining the ends of the drum. The drum is configured to receive a linear product wound about the drum. The inner flanges have locking gears on the outside faces of the inner flanges. The spool has an axle supporting the inner flanges and a pair of outer flanges. The outer flanges each have an outer flange gear positioned in their inner face and corresponding to the inner flange gear. The inner and outer flange gears cooperate to allow the drum to rotate in a first direction but not a second direction when the spool is supported by the outer flanges. The outer flanges are slightly taller than the inner flanges such that the spool may be positioned on a flat surface (e.g., truck bed or ground) and unwound without any equipment.

23 Claims, 10 Drawing Sheets

UNIDIRECTIONAL LOCKING SPOOL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to reels or spool is for storing and distributing linear products. More particularly, this invention pertains to reels or spool is for.

Spool is are used to store and distribute a length of material (i.e., a linear product) such as wire or cable. Spool is (i.e., reels) are constructed of metal, wood, plastic, polyhybrids and a mixture of these materials. Spool is are typically held together by steel rods, staples, screws, nails, and metal pipe (e.g., an axle). They have a center drum and end flanges. The center drum is routinely formed by a plurality of slats inset into circular grooves in the circular end flanges. The rods pull the flanges together to retain the slats in the circular grooves.

Take-up machines are used to wind wire or other linear materials onto spool is (i.e., onto the drum of a spool). The take-up machines engage the flanges and spin the flanges to pull the linear product onto the drum of the spool. The spool is then packaged (e.g., wrapped in plastic) and delivered to customers so that they may off load the linear product in a controlled manner without tangling for their purposes. Existing spool is require end users of linear products to have a system for unspooling the linear product in a controlled manner.

BRIEF SUMMARY OF THE INVENTION

Aspects of the present invention provide a spool for storing and distributing linear product. The spool has a drum and inner flanges defining the ends of the drum. The drum is configured to receive a linear product wound about the drum. The inner flanges have locking gears on the outside faces of the inner flanges. The spool has an axle supporting the inner flanges and a pair of outer flanges. The outer flanges each have an outer flange gear positioned in their inner face and corresponding to the inner flange gear. The inner and outer flange gears cooperate to allow the drum to rotate in a first direction but not a second direction when the spool is supported by the outer flanges. The outer flanges are slightly taller than the inner flanges such that the spool may be positioned on a flat surface (e.g., truck bed or ground) and unwound without any equipment. The spool may also be rolled without unwinding the linear product (i.e., length of material) from the drum.

In one aspect, a spool includes a drum, a first inner flange, a second inner flange, a first outer flange, and a second outer flange. The drum extends along the longitudinal axis. A portion of the drums configured to receive the length of material wound thereon. The first inner flange is configured to attach to the drum. The second inner flange is configured to attach to the drum. The first and second inner flange is defined the portion of the drum configured to receive the length of material when the spool is assembled. The drum, first inner flange, and second inner flange are configured to rotate together about the longitudinal axis when the spool is assembled. The drum, first inner flange, and second inner flange are rotatable around the longitudinal axis in a first direction relative to the first outer flange when the spool is assembled. The drum, first inner flange, and second inner flange are rotatable about the longitudinal axis in the first direction relative to the second outer flange when the spool is assembled. The drum, first inner flange, and second inner flange are not rotatable about the longitudinal axis in a second direction relative to the first outer flange when the spool is assembled. The drum, first inner flange, and second inner flange are not rotatable around the longitudinal axis in the second direction relative to the first outer flange when the spool is assembled. The first direction is opposite the second direction. In one embodiment, the drum is suspended or assembled by the locking gear. That is, the inner locking gear is integral with the inner flange such that the locking gear attached directly to opposing longitudinal ends of the drum.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
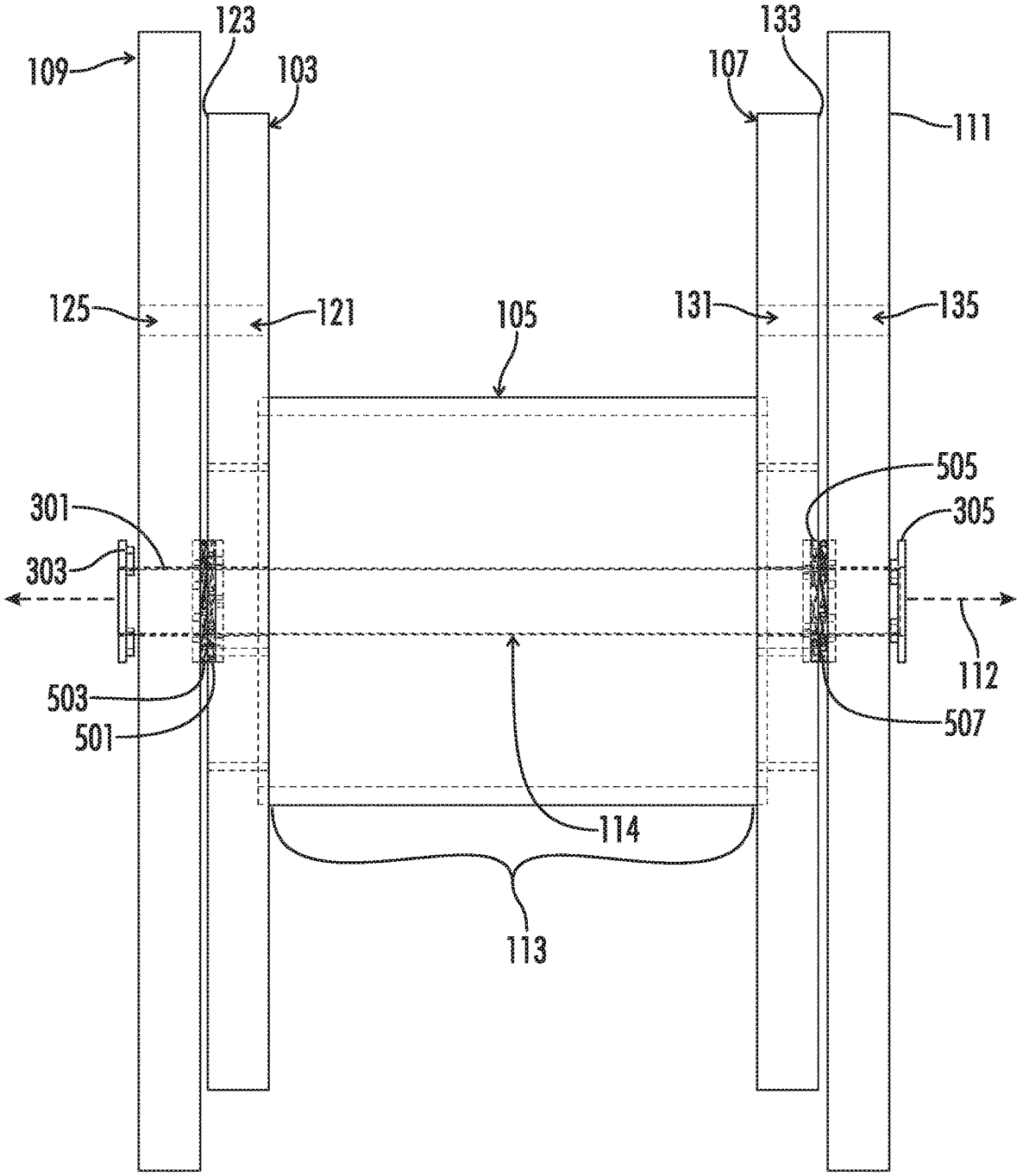
FIG. 1 is a front cutaway view of a spool according to one embodiment of the invention.
Figure 2:
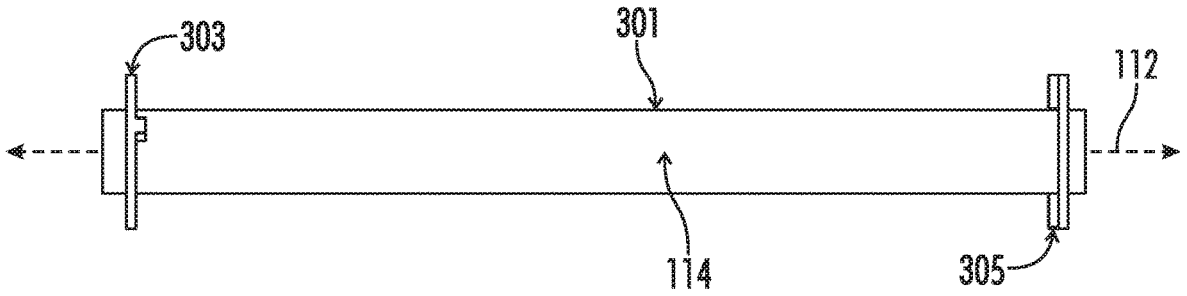
FIG. 2 is a perspective view of an axle of the spool of FIG. 1
Figure 3:
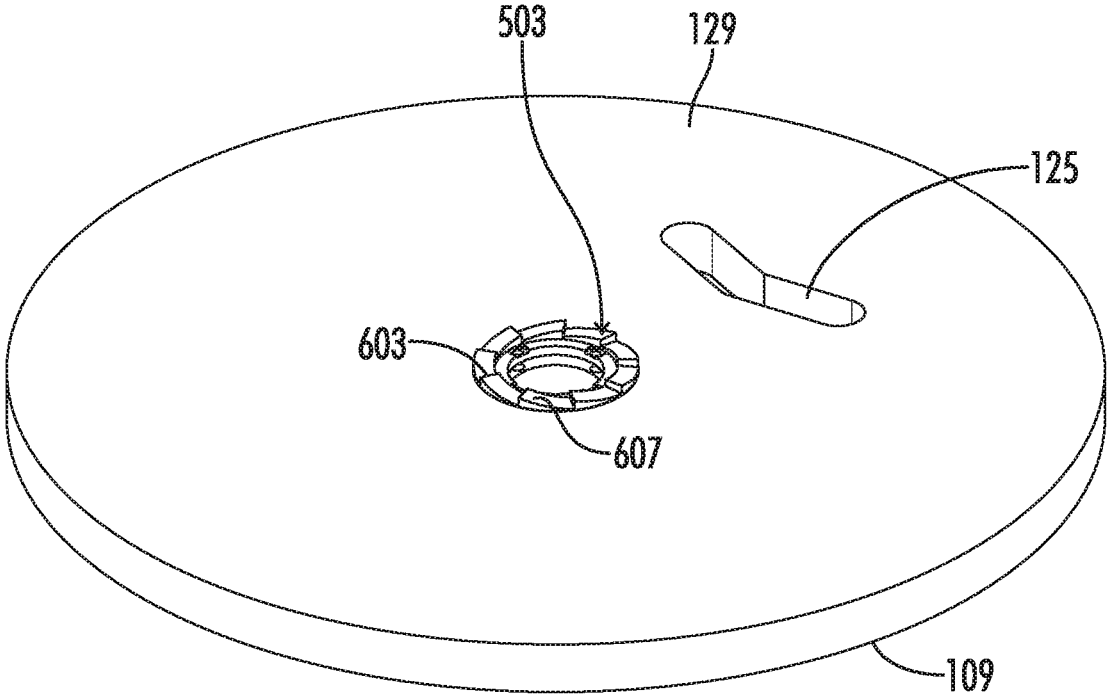
FIG. 3 is an isometric view of an outer flange assembly of the spool of FIG. 1.
Figure 4:
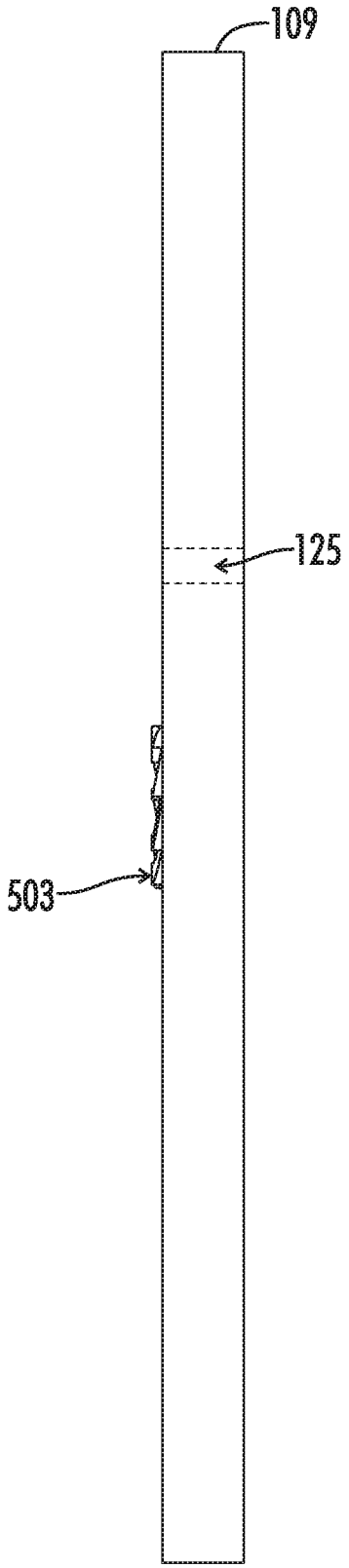
FIG. 4 is a front perspective view of the outer flange assembly of FIG. 3.
Figure 5:
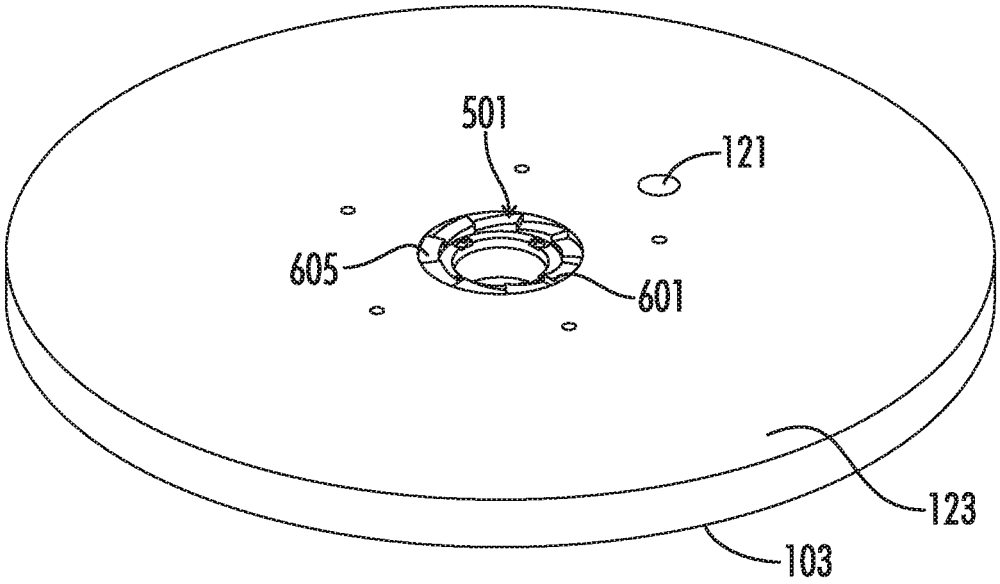
FIG. 5 is an isometric view of an inner flange assembly of the spool of FIG. 1.
Figure 6:
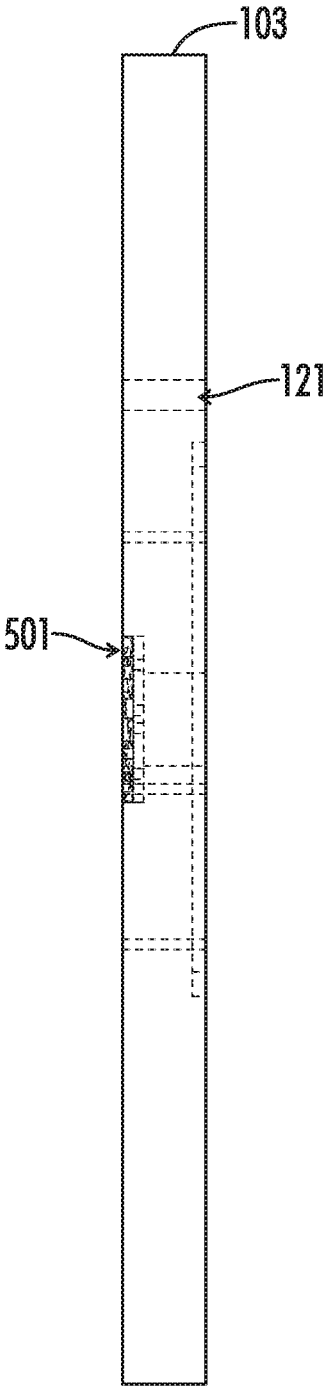
FIG. 6 is a front x-ray view of the inner flange assembly of FIG. 5.
Figure 7:
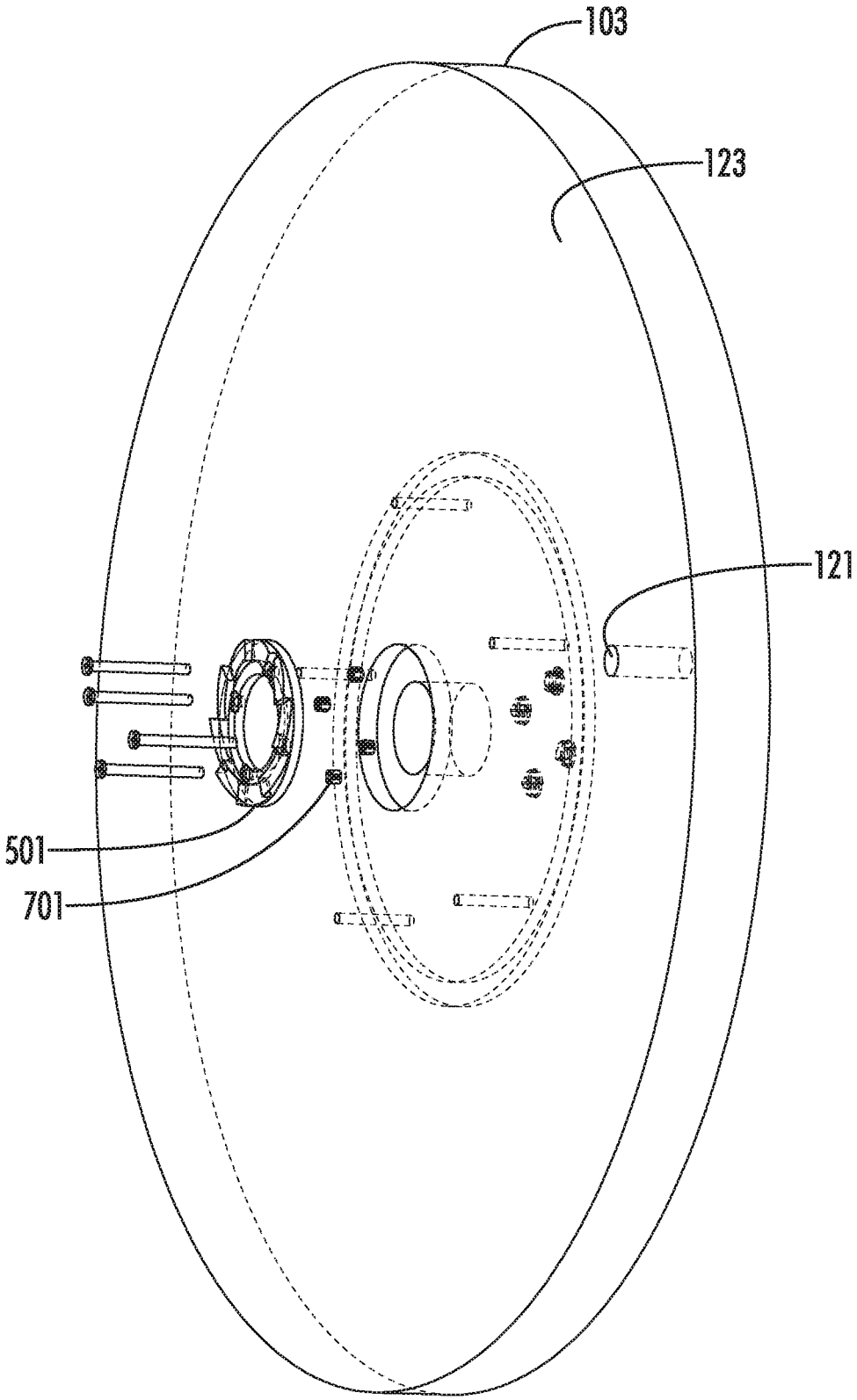
FIG. 7 is an exploded isometric view of the inner flange assembly of FIG. 5.
Figure 8:
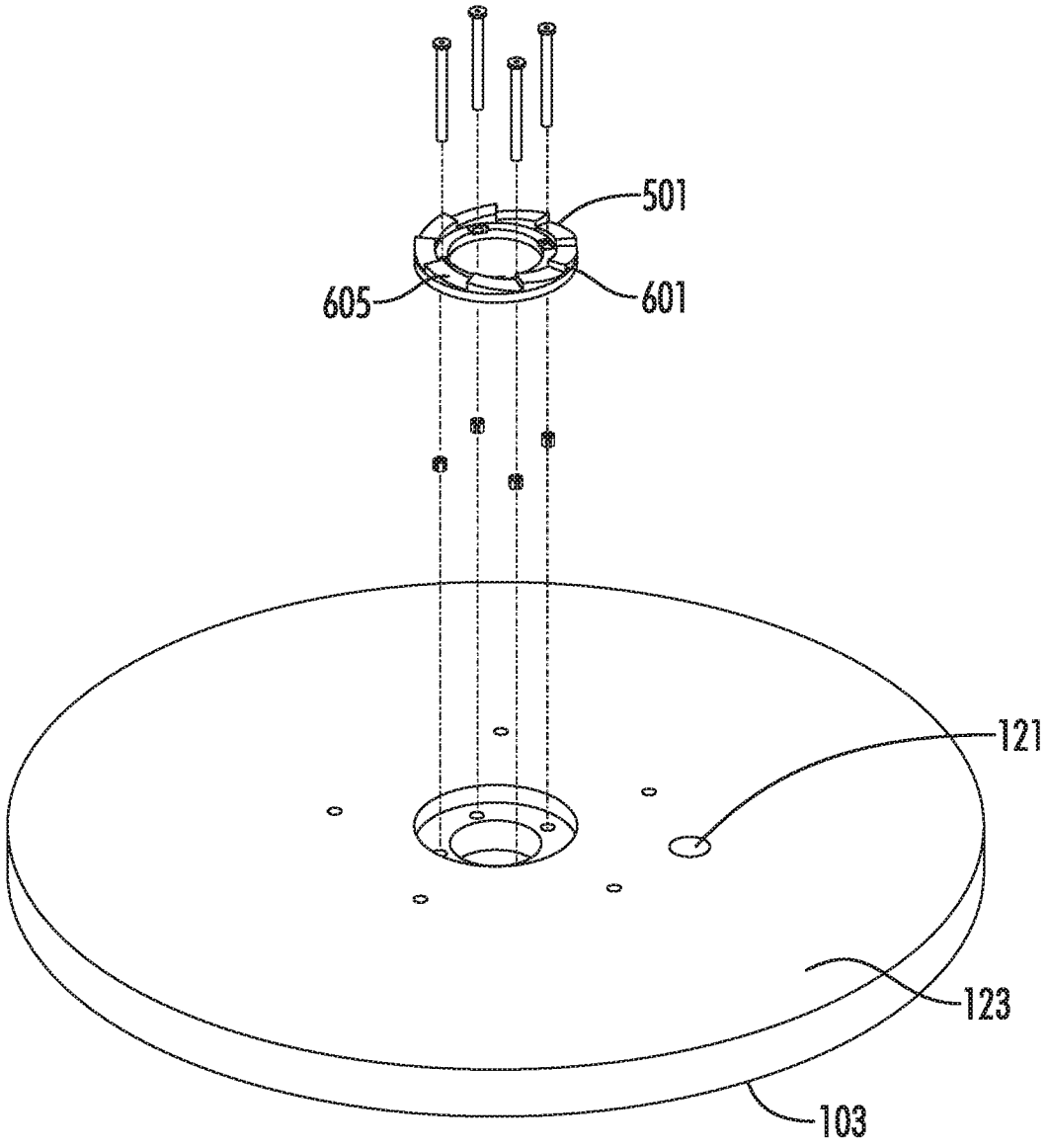
FIG. 8 is a partially exploded isometric view of the inner flange assembly of FIG. 5.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of a spool as used herein is with the longitudinal axis generally horizontal with the spool assembled as shown in, for example, FIGS. 1 and 2. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-8, a spool 100 includes a drum 105, a first inner flange 103, a second inner flange 107, a first outer flange 109, and a second outer flange 111. The drum 105 is configured to extend along a longitudinal axis 112. A portion of the drum 113 is configured to receive a length of material wound thereon. The first inner flange 103 is configured to attach to the drum 105. The second inner flange 107 is configured to attach to the drum 105. The first inner flange 103 and the second inner flange 107 define the portion of the drum 113 configured to receive the length of material when the spool 100 is assembled. In one embodiment, the first inner flange 103 is configured to attach to the drum 105 at a first longitudinal end of the drum 105, and the second inner flange 107 is configured to attach to the drum 105 at a second longitudinal end of the drum 105 opposite the first longitudinal end of the drum 105 when the spool 100 is assembled. In one embodiment, the first outer flange 109 is further from a longitudinal center 114 of the spool 100 than the first inner flange 103 when spool 100 is assembled. The second outer flange 111 is further from the center 114 of the spool 100 than the second inner flange 107 when the spool 100 is assembled. The first inner flange 103 is closer to the second inner flange 107 than the first outer flange 109 is to the second outer flange 111 when the spool 100 is assembled. The first outer flange 109 is further from the second inner flange 107 than the first inner flange 103 is from the second inner flange 107 when the spool 100 is assembled. The second outer flange 111 is further from the first inner flange 103 than the second inner flange 107 is from the first inner flange 103 when the spool 100 is assembled. In one embodiment, the spool 100 further includes the length of material (i.e., linear product) taken up on the portion 113 of the drum 105 configured to receive the linear product.

In one embodiment, the spool 100 further includes an axle 301. The axle 301 extends along the longitudinal axis 112. The axle 301 is configured to support the first inner flange 103, second inner flange 107, first outer flange 109, and second outer flange 111 when the spool 100 is assembled. In one embodiment, the spool 100 further includes a first collet 303 and a second collet 305. The first collet 303 is configured to limit longitudinal movement of the first outer flange 109 on the axle 301 away from the center 114 of the spool 100 when the spool 100 is assembled. The second collet 305 is configured to limit longitudinal movement of the second outer flange 111 on the axle 301 away from the center 114 of the spool 100 when the spool 100 is assembled. It is contemplated that the first and second collets 303, 305 may be collars, bands, or flanged ends of the axle 301 within the scope of the claims.

The drum 105, first inner flange 103, and second inner flange 107 are configured to rotate together about the longitudinal axis 112 when the spool 100 is assembled. The drum 105, first inner flange 103, and second inner flange 107 are rotatable about the longitudinal axis 112 in a first direction relative to the first outer flange 109 when the spool 100 is assembled. The drum 105, first inner flange 103, and second inner flange 107 are rotatable about the longitudinal axis 112 in the first direction relative to the second outer flange 111 when the spool 100 is assembled. The drum 105, first inner flange 103, and second inner flange 107 are not rotatable about the longitudinal axis 112 in a second direction relative to the first outer flange 109 when the spool 100 is assembled. The drum 105, first inner flange with 3, and second inner flange 107 are not rotatable about the longitudinal axis 112 in the second direction relative to the first outer flange 109 when the spool 100 is assembled. The first direction is opposite the second direction.

In one embodiment, the drum 105 is generally cylindrical. In one embodiment, the first inner flange 103, and second inner flange 107 each have a generally circular cross-section relative to the longitudinal axis 112. In one embodiment, the first outer flange 109 and the second outer flange 111 each have generally circular cross-sections relative to the longitudinal axis 112. In one embodiment, the generally circular cross-section of the first inner flange 103 and the generally circular cross-section of the second inner flange 107 have a diameter less than a diameter of the generally circular cross-section of the first outer flange 109 and the generally circular cross-section of the second outer flange 111. Because the first outer flange 109 and second outer flange 111 have larger diameters than the first inner flange 103 and second inner flange 107, the spool 100 may be placed directly on a surface and loaded or unloaded without the use of a machine. The first outer flange 109 and the second outer flange 111 suspend the first inner flange 103, second inner flange 107, and drum 105 above the surface such that they may rotate freely in the first direction. Depending on the orientation of the spool 100, the spool 100 may thus be loaded or unloaded without additional equipment (e.g., a take-up device for loading or a spool stand for unloading).

In one embodiment, the spool 100 has provisions for use with a take-up device (i.e. a device for winding the length of material or linear product onto the drum 105). The first inner flange 103 has a recess 121 in an outer surface 123 of the first inner flange 103. The recess 121 and the outer surface 123 of the first inner flange 103 is configured to receive the take-up device. The first outer flange 109 has a whole 125 there through configured to align with the recess 121 in the outer surface 123 of the first inner flange 103 such that the take-up device can interface with the recess 121 in the outer surface 123 of the first inner flange 103 and the first outer flange 109 is rotationally locked to the first inner flange 103 when the take-up device engages the recess 121 and the outer surface 123 of the first inner flange 103. In one embodiment, the second inner flange 107 similarly has a recess 131 in an outer surface 133 of the second inner flange 107. The recess 131 in the outer surface 133 of the second inner flange 107 is configured to receive the take-up device. The second outer flange 111 has a hole 135 there through configured to align with the recess 131 in the outer surface 133 of the second inner flange 107 such that the take-up device can interface with the recess 131 and the outer surface 133 of the second inner flange 107 and the second outer flange 111 is rotationally locked to the second inner flange 107 when the take-up device engages the recess 131 and the outer surface 133 of the second inner flange 107.

In one embodiment, the spool 100 further includes an inner flange gear 501 and an outer flange gear 503. The inner flange gear 501 is configured to attach to the first inner flange 103 such that the inner flange gear 501 cannot rotate with respect to the first inner flange 103 when the spool 100 is assembled. The outer flange gear 503 is configured to attach to the first outer flange 109 such that the outer flange gear 503 cannot rotate with respect to the first outer flange 109 when the spool 100 is assembled. The inner flange gear 501 and outer flange gear 503 cooperate to allow rotation of the first inner flange 103, drum 105, and second inner flange 107 about the longitudinal axis 112 relative to the first outer flange 109 in the first direction when the spool 100 is assembled. The inner flange gear 501 and outer flange gear 503 similarly cooperate to prevent rotation of the drum 105, first inner flange 103, and second inner flange 107 about the longitudinal axis 112 relative to the first outer flange 109 in the second direction when the spool 100 is assembled. In one embodiment, the outer flange gear 503 protrudes from an inner surface 129 of the outer flange 109 when the spool 100 is assembled. In one embodiment, the inner flange gear 501 is at least partially recessed into the outer surface 123 of the inner flange 103 when the spool 100 is assembled.

In one embodiment, front surfaces 601 of teeth of the inner flange gear 103 are at an acute angle with respect to the outer surface 123 of the first inner flange 103 when the spool 100 is assembled. Front surfaces 603 of teeth of the outer flange gear 503 are at an acute angle with respect to the inner surface 129 of the first outer flange 109 when the spool 100 is assembled. Rear surfaces 605 of the teeth of the inner flange gear 501 are at an obtuse angle with respect to the outer surface 123 of the first inner flange 103 when the spool 100 is assembled. Rear surfaces 607 of the teeth of the outer flange gear 503 are at an obtuse angle with respect to the inner surface 129 of the first outer flange 109 when the spool 100 is assembled. The front surfaces 601 of the teeth of the inner flange gear 501 and the front surfaces 603 of the outer flange gear 503 contact one another and pull the inner flange gear 501 and outer flange gear 503 toward one another and interlock when the drum 105, the first inner flange 103, and the second inner flange 107 are rotated about the longitudinal axis 112 relative to the first outer flange 109 in the second direction. The rear surfaces 605 of the teeth of the inner flange gear 501 and the rear surfaces 607 of the teeth of the outer flange gear 503 contact one another and push the inner flange gear 501 and outer flange gear 503 apart when the drum 105, first inner flange 103, and second inner flange 107 are rotated about the longitudinal axis 112 relative to the first outer flange 109 in the first direction.

In one embodiment, the inner flange gear 501 and the outer flange gear 503 are a first inner flange gear and a first outer flange gear 503. The spool 100 further includes a second inner flange gear 505 and a second outer flange gear 507. The second inner flange gear 505 is configured to attach to the second inner flange 107 such that the second inner flange gear 505 cannot rotate with respect to the second inner flange 107 when the spool 100 is assembled. The second outer flange gear is configured to attach to the second outer flange 111 such that the second outer flange gear 507 cannot rotate with respect to the second outer flange 111 when the spool 100 is assembled. The second inner flange gear 505 and second outer flange gear 507 cooperate to allow rotation of the second inner flange 107, drum 105, and first inner flange 103 about the longitudinal axis 112 relative to the second outer flange 111 in the first direction when the spool 100 is assembled. The second inner flange gear 505 and second outer flange gear 507 cooperate to prevent rotation of the drum 105, the first inner flange 103, and the second inner flange 107 about the longitudinal axis 112 relative to the second outer flange 111 in the second direction when the spool 100 is assembled.

In one embodiment, the spool 100 further includes at least one spring 701. The spring 701 is configured to bias the inner flange gear 501 and outer flange gear 503 into contact with one another when the spool 100 is assembled. In one embodiment, the spring 701 is positioned between the first inner flange 103 and the inner flange gear 501 when the spool 100 is assembled, and in another embodiment, the spring 701 is positioned between the first outer flange 109 and the outer flange gear 503 when the spool 100 is assembled. It is contemplated within the scope of the claims that multiple springs may be used, and springs may be used on both the first inner flange 103 and the second inner flange 107, both the first outer flange 109 and second outer flange 111, only the first inner flange 103, only the second inner flange 107, only the first outer flange 109, or only the second outer flange 111.

Figure 9:
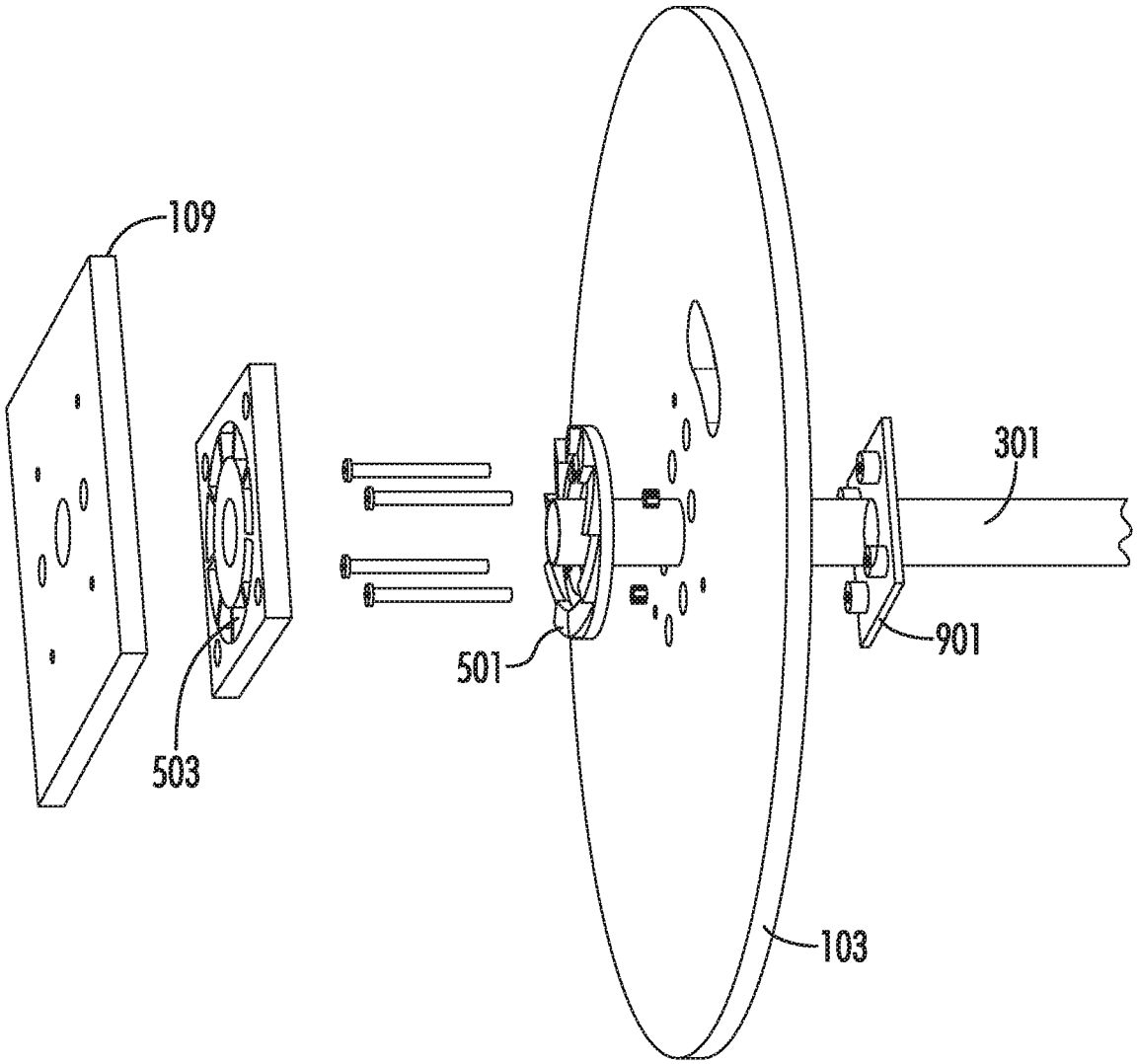
FIG. 9 is a partially exploded isometric view of locking spool assembly with a rectangular outer gear and a circular outer flange.
Figure 10:
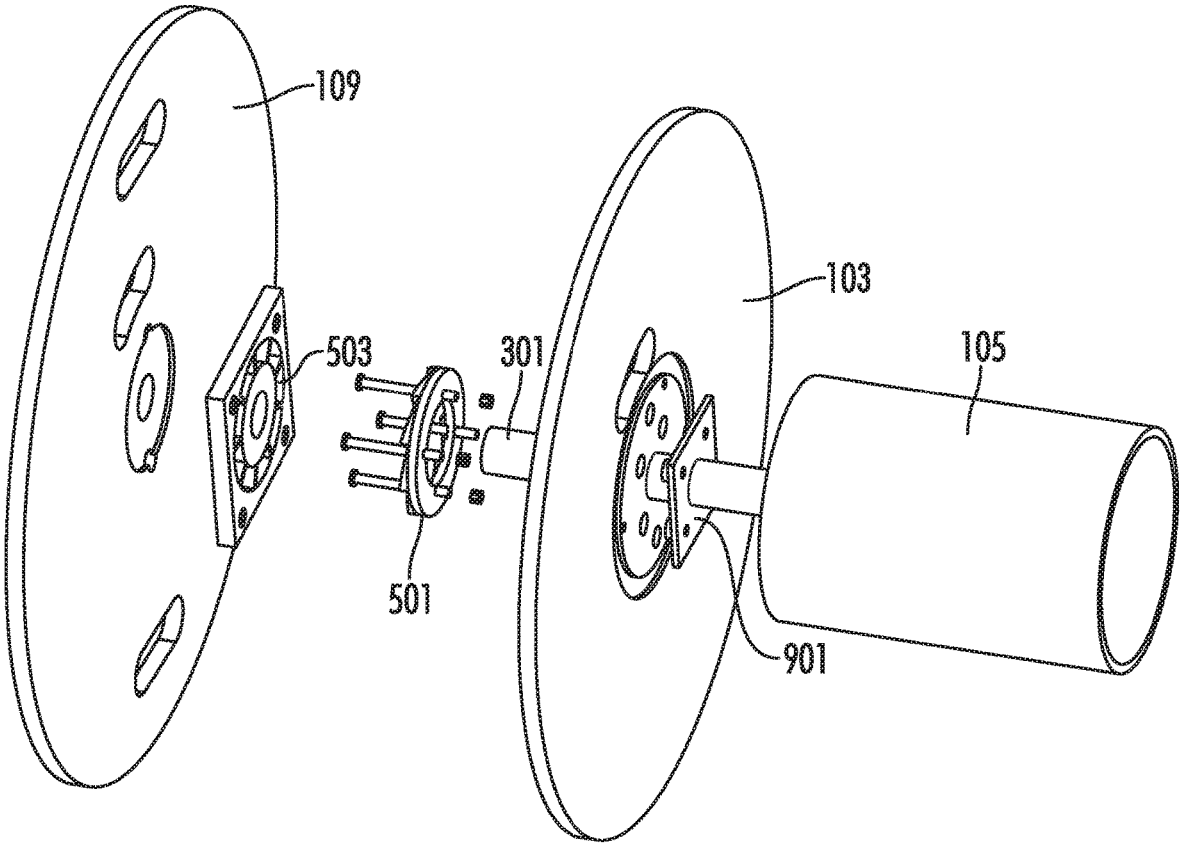
FIG. 10 is a partially exploded isometric view of the locking spool assembly with the rectangular outer gear of FIG. 10 and a rectangular box mount outer flange.

Referring to FIGS. 9-10, in one embodiment, an outer gear 503 is shown with both front and rear gear faces perpendicular to the inner face of the outer gear 503. The front and rear gear faces extend through the outer gear 503. In one embodiment, the axle 301 has mounting flange 901 with integral threading to receive bolts securing the inner locking gear 501 to the inner flange 103 and axle 301. In one embodiment, the outer gear 503 is integral with the outer flange 109. In one embodiment, the outer flange 109 or outer gear 503 is rectangular with respect to the longitudinal axis, and the rectangle has a width less than the diameter of the inner flange 103. As used herein, a component "configured to attach to" another component may mean integral with the component such that the components are always attached to one other before and after assembly of the spool 100.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful UNIDIRECTIONAL LOCKING SPOOL it is not intended that such references be construed as limitations upon the scope of this invention except as set forth in the following claims.

What is claimed is:

1. A spool comprising:

a drum extending along a longitudinal axis, wherein a portion of the drum is configured to receive a length of material wound thereon;

a first inner flange configured to attach to the drum;

a second inner flange configured to attach to the drum;

a first outer flange;

a second outer flange, wherein:

the first and second inner flanges define the portion of the drum configured to receive the length of material when the spool is assembled;

the drum, first inner flange, and second inner flange are configured to rotate together about the longitudinal axis when the spool is assembled;

the drum, first inner flange, and second inner flange are rotatable about the longitudinal axis in a first direction relative to the first outer flange when the spool is assembled;

the drum, first inner flange, and second inner flange are rotatable about the longitudinal axis in the first direction relative to the second outer flange when the spool is assembled;

the drum, first inner flange, and second inner flange are not rotatable about the longitudinal axis in a second direction relative to the first outer flange when the spool is assembled;

the first direction is opposite the second direction;

an inner flange gear configured to attach to the first inner flange such that the inner flange gear cannot rotate with respect to the first inner flange when the spool is assembled; and an outer flange gear configured to attach to the first outer flange such that the outer flange gear cannot rotate with respect to the first outer flange when the spool is assembled, wherein:

the inner flange gear and outer flange gear cooperate to allow rotation of the first inner flange, drum, and second inner flange about the longitudinal axis relative to the first outer flange in the first direction when the spool is assembled; and the inner flange gear and outer flange gear cooperate to prevent rotation of the drum, the first inner flange, and the second inner flange about the longitudinal axis relative to the first outer flange in the second direction when the spool is assembled.

2. The spool of claim 1, wherein:

the first inner flange has a recess in an outer surface of said first inner flange;

the recess in the outer surface of the first inner flange is configured to receive a take up device; and the first outer flange has a hole therethrough configured to align with the recess in the outer surface of the first inner flange such that the take-up device can interface with the recess in the outer surface of the first inner flange and the first outer flange is rotationally locked to the first inner flange when the take-up device engages the recess in the outer surface of the first inner flange.

3. The spool of claim 1, wherein:

the first inner flange has a recess in an outer surface of said first inner flange;

the recess in the outer surface of the first inner flange is configured to receive a take up device;

the first outer flange has a hole therethrough configured to align with the recess in the outer surface of the first inner flange such that the take-up device can interface with the recess in the outer surface of the first inner flange and the first outer flange is rotationally locked to the first inner flange when the take-up device engages the recess in the outer surface of the first inner flange;

the second inner flange has a recess in an outer surface of said second inner flange;

the recess in the outer surface of the second inner flange is configured to receive the take up device; and the second outer flange has a hole therethrough configured to align with the recess in the outer surface of the second inner flange such that the take-up device can interface with the recess in the outer surface of the second inner flange and the second outer flange is rotationally locked to the second inner flange when the take-up device engages the recess in the outer surface of the second inner flange.

4. The spool of claim 1, wherein:

the drum is generally cylindrical.

5. The spool of claim 1, wherein:

the first inner flange has a generally circular cross section relative to the longitudinal axis; and the second inner flange has a generally circular cross section relative to the longitudinal axis.

6. The spool of claim 1, wherein:

the first outer flange has a generally circular cross section relative to the longitudinal axis; and the second outer flange has a generally circular cross section relative to the longitudinal axis.

7. The spool of claim 1, wherein:

the first inner flange has a generally circular cross section relative to the longitudinal axis;

the second inner flange has a generally circular cross section relative to the longitudinal axis;

the first outer flange has a generally circular cross section relative to the longitudinal axis;

the second outer flange has a generally circular cross section relative to the longitudinal axis; and the generally circular cross section of the first inner flange and the generally circular cross section of the second inner flange have a diameter less than a diameter of the generally circular cross section of the first outer flange and the generally circular cross section of the second outer flange.

8. The spool of claim 1, wherein:

the first inner flange is configured to attach to the drum at a first longitudinal end of the drum; and the second inner flange is configured to attach to the drum at a second longitudinal end of the drum opposite the first longitudinal end of the drum.

9. The spool of claim 1, wherein:

the first inner flange is configured to attach to the drum at a first longitudinal end of the drum;

the second inner flange is configured to attach to the drum at a second longitudinal end of the drum opposite the first longitudinal end of the drum;

the first outer flange is further from a center of the spool than the first inner flange when the spool is assembled;

the second outer flange is further from the center of the spool than the second inner flange when the spool is assembled; and the first inner flange is closer to the second inner flange than the first outer flange is to the second outer flange when the spool is assembled;

the first outer flange is further from the second inner flange than the first inner flange is from the second inner flange when the spool is assembled; and the second outer flange is further from the first inner flange than the second inner flange is from the first inner flange when the spool is assembled.

10. The spool of claim 1, further comprising:

an axle extending along the longitudinal axis, wherein the axle is configured to support the first inner flange, second inner flange, first outer flange, and second outer flange when the spool is assembled.

11. The spool of claim 1, wherein:

an axle extending along the longitudinal axis, wherein the axle is configured to support the first inner flange, second inner flange, first outer flange, and second outer flange when the spool is assembled;

a first collet configured to limit longitudinal movement of the first outer flange on the axle away from a center of the spool when the spool is assembled; and a second collet configured to limit longitudinal movement of the second outer flange on the axle away from the center of the spool when the spool is assembled.

12. The spool of claim 1, wherein:

the inner flange gear and outer flange gear are a first inner flange gear and a first outer flange gear, respectively;

the spool further comprises a second inner flange gear configured to attach to the second inner flange such that the second inner flange gear cannot rotate with respect to the second inner flange when the spool is assembled; and the spool further comprises a second outer flange gear configured to attach to the second outer flange such that the second outer flange gear cannot rotate with respect to the second outer flange when the spool is assembled;

the second inner flange gear and second outer flange gear cooperate to allow rotation of the second inner flange, drum, and first inner flange about the longitudinal axis relative to the second outer flange in the first direction when the spool is assembled; and the second inner flange gear and second outer flange gear cooperate to prevent rotation of the drum, the first inner flange, and the second inner flange about the longitudinal axis relative to the second outer flange in the second direction when the spool is assembled.

13. The spool of claim 1, wherein:

the outer flange gear protrudes from an inner surface of the outer flange when the spool is assembled.

14. The spool of claim 1, wherein:

the inner flange gear is at least partially recessed into an outer surface of the inner flange when the spool is assembled.

15. The spool of claim 1, wherein:

inner flange gear is attached to an outside surface of the first inner flange when the spool is assembled;

outer flange gear is attached to an inside surface of the first outer flange when the spool is assembled;

front surfaces of teeth of the inner flange gear are at an acute angle with respect to the outer surface of the first inner flange when the spool is assembled;

front surfaces of teeth of the outer flange gear are at an acute angle with respect to the inner surface of the first outer flange when the spool is assembled;

rear surfaces of the teeth of the inner flange gear are at an obtuse angle with respect to the outer surface of the first inner flange when the spool is assembled; and rear surfaces of the teeth of the outer flange gear are at an obtuse angle with respect to the inner surface of the first outer flange when the spool is assembled such that:

the front surfaces of the teeth of the inner flange gear and the front surfaces of the teeth of the outer flange gear contact one another and pull the inner flange gear and outer flange gear toward one another and interlock when the drum, the first inner flange, and the second inner flange are rotated about the longitudinal axis relative to the first outer flange in the second direction; and the rear surfaces of the teeth of the inner flange gear and the rear surfaces of the teeth of the outer flange gear contact one another and push the inner flange gear and outer flange gear apart when the drum, first inner flange, and second inner flange are rotated about the longitudinal axis relative to the first outer flange in the first direction.

16. The spool of claim 1, further comprising:

at least one spring, wherein:

the spring is configured to bias the inner flange gear and outer flange gear into contact with one another when the spool is assembled.

17. The spool of claim 1, further comprising:
at least one spring, wherein:
the spring is configured to bias the inner flange gear and outer flange gear into contact with one another when the spool is assembled; and
the spring is positioned between the first inner flange and the inner flange gear when the spool is assembled.

18. The spool of claim 1, further comprising:
at least one spring, wherein:
the spring is configured to bias the inner flange gear and outer flange gear into contact with one another when the spool is assembled; and
the spring is positioned between the first outer flange and the outer flange gear when the spool is assembled.

19. The spool of claim 1, further comprising:
the length of material, wherein the length of material is a linear product and the linear product is wound about the drum.

20. The spool of claim 1, wherein:
the first outer flange has a generally rectangular cross section relative to the longitudinal axis;
the second outer flange has a generally rectangular cross section relative to the longitudinal axis;
the first inner flange has a generally circular cross section relative to the longitudinal axis; and
the second inner flange has a generally circular cross section relative to the longitudinal axis, wherein:
a diameter of the first inner flange and a diameter of the second inner flange are larger than a width of the first outer flange; and
a diameter of the first inner flange and a diameter of the second inner flange are larger than a width of the second outer flange.

21. The spool of claim 1, further comprising:
an axle extending along the longitudinal axis, wherein the axle is configured to support the first inner flange, second inner flange, first outer flange, and second outer flange when the spool is assembled; and
a first mounting plate configured to attach to the axle and the first inner flange when the spool is assembled; and
a second mounting plate configured to attach to the axle and the second inner flange when the spool is assembled, wherein:
the first mounting plate is integral with the axle; and
the second mounting plate is integral with the axle.

22. The spool of claim 1,
wherein:
the inner flange gear is attached to an outside surface of the first inner flange when the spool is assembled;
the outer flange gear forms an inside surface of the first outer flange when the spool is assembled;
front surfaces of teeth of the inner flange gear are at an acute angle with respect to the outer surface of the first inner flange when the spool is assembled;
front surfaces of teeth of the outer flange gear are perpendicular to the inner surface of the first outer flange when the spool is assembled;
rear surfaces of the teeth of the inner flange gear are at an obtuse angle with respect to the outer surface of the first inner flange when the spool is assembled; and
rear surfaces of the teeth of the outer flange gear are perpendicular to the inner surface of the first outer flange when the spool is assembled such that:
the rear surfaces of the teeth of the inner flange gear and the rear surfaces of the teeth of the outer flange gear contact one another and push the inner flange gear and outer flange gear apart when the drum, first inner flange, and second inner flange are rotated about the longitudinal axis relative to the first outer flange in the first direction, and
the front surfaces of the teeth of the inner flange gear and the front surfaces of the teeth of the outer flange gear contact one another to prevent rotation of the drum, first inner flange, and second inner flange are rotated about the longitudinal axis relative to the first outer flange in the second direction.

23. A spool comprising:
a drum extending along a longitudinal axis, wherein a portion of the drum is configured to receive a length of material wound thereon;
a first inner flange configured to attach to the drum;
a second inner flange configured to attach to the drum;
a first outer flange;
a second outer flange, wherein:
the first and second inner flanges define the portion of the drum configured to receive the length of material when the spool is assembled;
the drum, first inner flange, and second inner flange are configured to rotate together about the longitudinal axis when the spool is assembled;
the drum, first inner flange, and second inner flange are rotatable about the longitudinal axis in a first direction relative to the first outer flange when the spool is assembled;
the drum, first inner flange, and second inner flange are rotatable about the longitudinal axis in the first direction relative to the second outer flange when the spool is assembled;
the drum, first inner flange, and second inner flange are not rotatable about the longitudinal axis in the second direction relative to the first outer flange when the spool is assembled; and
the first direction is opposite the second direction;
an axle extending along the longitudinal axis, wherein the axle is configured to support the first inner flange, second inner flange, first outer flange, and second outer flange when the spool is assembled; and
a first mounting plate configured to attach to the axle and the first inner flange when the spool is assembled; and
a second mounting plate configured to attach to the axle and the second inner flange when the spool is assembled, wherein:
the first mounting plate is integral with the axle; and
the second mounting plate is integral with the axle.

* * * * *